US007896210B2

(12) United States Patent
Popovich et al.

(10) Patent No.: US 7,896,210 B2
(45) Date of Patent: Mar. 1, 2011

(54) FASTENER ACTUATION SYSTEM

(75) Inventors: Michael S. Popovich, Bartlett, IL (US); Tomasz Sikora, River Grove, IL (US)

(73) Assignee: Illinois Tool Works Inc., Glenview, IL (US)

( * ) Notice: Subject to any disclaimer, the term of this patent is extended or adjusted under 35 U.S.C. 154(b) by 198 days.

(21) Appl. No.: 12/428,996

(22) Filed: Apr. 23, 2009

(65) Prior Publication Data

US 2010/0270352 A1 Oct. 28, 2010

(51) Int. Cl.
*B25C 1/14* (2006.01)

(52) U.S. Cl. ..... 227/8; 227/10

(58) Field of Classification Search ..... 227/8, 9, 227/10, 29, 156

See application file for complete search history.

(56) References Cited

U.S. PATENT DOCUMENTS 3,643,850 A * 2/1972 Endo et al. ..... 227/8
3,797,721 A * 3/1974 Clumb ..... 227/9
4,153,193 A 5/1979 Urbanowicz
4,479,599 A 10/1984 Conrad
5,016,802 A * 5/1991 Haytayan ..... 227/11
5,135,150 A * 8/1992 Chun ..... 227/9
5,429,291 A 7/1995 Thompson
5,465,893 A * 11/1995 Thompson ..... 227/8
5,518,161 A 5/1996 Thompson
5,897,045 A 4/1999 Olvera
6,364,190 B1 4/2002 Tor
6,547,120 B1 4/2003 Popovich et al.
7,014,085 B2 3/2006 McCullough
7,097,085 B2 * 8/2006 Arnold et al. ..... 227/9
7,121,598 B2 10/2006 Pourtier et al.
7,228,917 B2 6/2007 Davis et al.
7,258,261 B1 8/2007 Reyes (Continued)

FOREIGN PATENT DOCUMENTS

EP 1 484 139 A1 12/2004

(Continued)

OTHER PUBLICATIONS

International Searching Authority, ISA/EP, International Search Report and Written Opinion mailed Jul. 21, 2010 for PCT International Application PCT/US2010/028836, International Filing Date Mar. 26, 2010; 13 pages.

*Primary Examiner* — Scott A. Smith
(74) *Attorney, Agent, or Firm* — Mark W. Croll; Christopher P. Rauch; Beem Patent Law Firm

(57) ABSTRACT

A fastener actuation system for driving fasteners into a work surface separated a significant distance from a user, the system comprising a fastener actuation tool coupled to a pole assembly, the assembly including a lockout mechanism. The tool may have a firing pin assembly configured such that depression of the barrel assembly against the work surface loads a firing pin into a ready-to-fire position. In addition, the tool may have a trigger sleeve slidable within the tool housing and having a ramp surface such that forward motion of the trigger sleeve may cause a trigger sear to move along the ramp surface until a point where the sear disengages and the firing pin fires. Moreover, the trigger sleeve may operationally engage an advance lever for automatically engaging cartridges. Additionally, the tool system may comprise a pole assembly having a secondary mechanism such as an external sleeve for firing the tool.

20 Claims, 7 Drawing Sheets

U.S. PATENT DOCUMENTS

| | | | | |
|---|---|---|---|---|
| 7,584,879 | B2 * | 9/2009 | Blessing et al. | 227/129 |
| 7,597,227 | B2 * | 10/2009 | Blessing et al. | 227/8 |
| 2008/0029567 | A1 | 2/2008 | Blessing et al. | |
| 2008/0106019 | A1 | 5/2008 | Blessing et al. | |
| 2008/0296338 | A1 | 12/2008 | Blessing et al. | |
| 2008/0302849 | A1 | 12/2008 | Blessing et al. | |

FOREIGN PATENT DOCUMENTS

| | | | |
|---|---|---|---|
| EP | 1 997 589 | A1 | 12/2008 |

* cited by examiner

FASTENER ACTUATION SYSTEM

BACKGROUND OF THE INVENTION

1. Field of the Invention

The present invention is directed to a fastener actuation or driving system, or the components thereof, for installing fasteners in a substrate, for example in an overhead application.

2. Description of the Related Art

A variety of different fastening driving tools exist for driving fasteners into numerous substrates, including tools used to install fasteners in situations where a significant separation between the user and the muzzle of the tool exists such as when a user wants to drive a fastener into a ceiling substrate. In these situations, fasteners may be loaded individually into the muzzle end of the tool while charges to drive the fasteners may be fed into the tool at a position behind a piston. Combustion of a charge causes the piston to be driven forward, thereby driving the fastener forward and into the substrate.

Due to the separation that may exist between the user and the muzzle of the tool, several tools employ an apparatus for extending the user's reach and for firing the tool. Oftentimes, tools with these extensions are fired by compressing the tool against the substrate or work surface and then providing a secondary compressive force to the entire apparatus to cause the tool to fire.

One drawback of tools operating in this fashion is the possibility of inadvertent actuation or misfiring. Applying too much pressure initially may cause the tool to actuate prematurely, which may cause the fastener to be driven in an undesired location or orientation. Alternatively, this pressure may cause the firing sequence to occur out of order, for example, causing the firing pin to release without sufficient force to combust a cartridge, resulting in a misfire of the tool.

What is needed is a fastener actuation system that overcomes the drawbacks described above.

BRIEF SUMMARY OF THE INVENTION

In one embodiment, a fastener actuation system may comprise a fastener actuation tool coupled to a pole assembly. The tool may include a housing having a barrel assembly slidable therein, the barrel assembly having a rod extending generally rearward from a breech end. The tool may also include a piston slidable within the barrel assembly, a breech block coupled to the housing, a firing pin assembly slidable within the breech block, a firing pin sear coupled to the firing pin assembly, a trigger sleeve slidable with respect to the housing and firing pin assembly. In addition, the trigger sleeve may be coupled to a limiter and an advance pin, and may have a rod contacting portion at a rear end. Moreover, the tool may have an advance lever adapted to be engaged by the advance pin and a finger for advancing a load-carrying strip.

The pole assembly may comprise a pole extending substantially along a length of the pole assembly, a handle coupled to the pole, an internal rod within the pole and slidable with respect to the pole and a sleeve external to the pole and coupled to the internal rod. The pole assembly further may include a lockout mechanism proximate a forward end of the pole assembly, the mechanism comprising a coupler and a reinforcing sleeve at an end of the assembly; and the lockout mechanism further may comprise a channel extending inward from a rear end of the reinforcing sleeve, the channel having an outer wall that tapers inward proximate a forward end of the channel, and at least one ball movable within the channel. The sleeve may have a thickness and the at least one ball may have a diameter, such that a rear end of the channel may have a width greater than the combination of the thickness and the diameter, and further wherein the forward end of said channel may have a width less than the combination of the thickness and the diameter.

In another embodiment, a fastener actuation tool comprising: a housing; a barrel assembly at least partially contained within the housing and slidable with respect to the housing, a piston within the barrel assembly and slidable with respect to the barrel assembly and the housing; a breech block generally fixed with respect to the housing; a firing pin assembly at least partially contained within the breech block and slidable with respect to the breech block, the firing pin assembly comprising a firing pin tip, a spring, a rebounder and a firing pin sear. The firing pin sear may be slidable along a channel in the breech block, and a trigger sleeve may be slidable with respect to the housing and firing pin assembly.

The trigger sleeve may have a tapered forward surface for contacting and releasing the firing pin sear. In addition, the firing pin tip may be biased to a generally forward starting position by a compression spring, and the trigger sleeve may be biased to a generally rearward starting position by a second compression spring.

Depressing the barrel assembly against a work surface may load the firing pin assembly into a ready-to-fire position. In addition, sliding the trigger sleeve toward the barrel assembly may release the firing pin sear, accelerating the firing pin assembly toward a load in the breech block and detonating the load upon impact, driving the piston forward, thereby driving the fastener into the work surface.

An advance lever may be coupled to the housing, biased to a rest position using a torsion spring. The advance lever may also have a surface for interfacing with an advance pin coupled to the trigger sleeve, wherein forward movement of the trigger sleeve depresses an advance lever, and rearward movement of the trigger sleeve may raise the finger, thereby advancing an unused cartridge into the breech block.

In yet another embodiment, a fastener actuation pole assembly may comprise a pole having a tool end and a handle end, the pole extending substantially a length of the pole assembly and coupled to a handle at the handle end. The pole assembly may further include a coupler at a tool end of the pole for engaging a tool, the coupler extending a predetermined length within the pole, an internal rod within the pole and slidable with respect to the pole; and a sleeve around at least a portion of the pole, the sleeve coupled to, and slidable with, the internal rod. In addition, the pole assembly may include a reinforcing sleeve coupled to and disposed around said pole at said tool end. Moreover, the pole assembly may include a cap at a handle end of the internal rod and a slot in the pole proximate the handle end of the pole, wherein the cap may couple to the internal rod and the coupler may connect the cap to the sleeve, the coupler passing through the slot.

These and other features and advantages are evident from the following description of the present invention, with reference to the accompanying drawings.

DETAILED DESCRIPTION OF THE INVENTION

Figure 8:
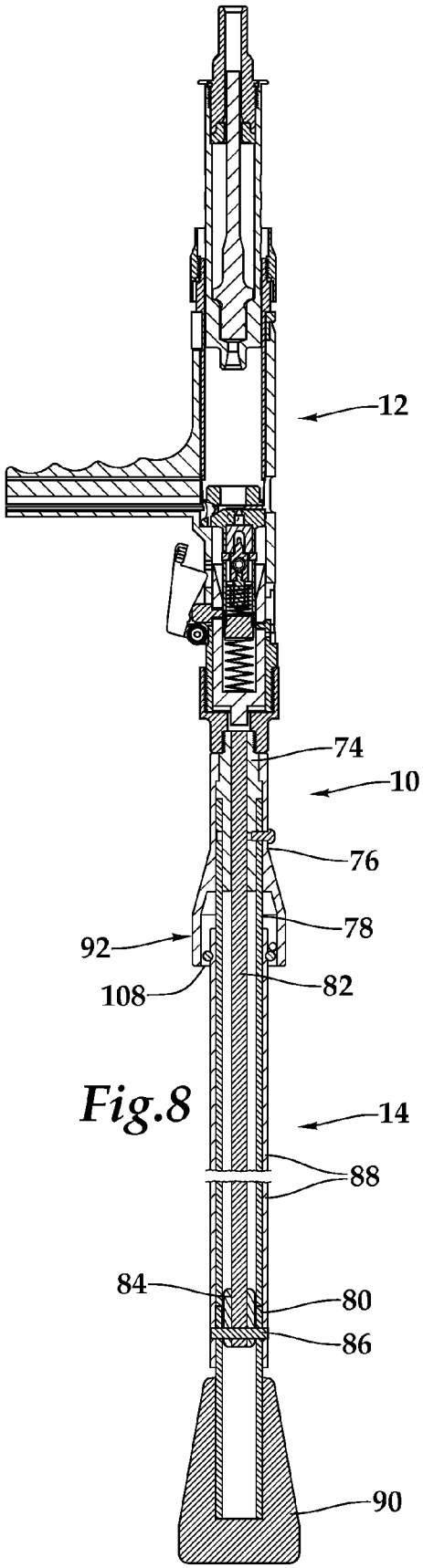
FIG. 8 is a sectional view of an exemplary tool system in a pre-firing position.
Figure 9:
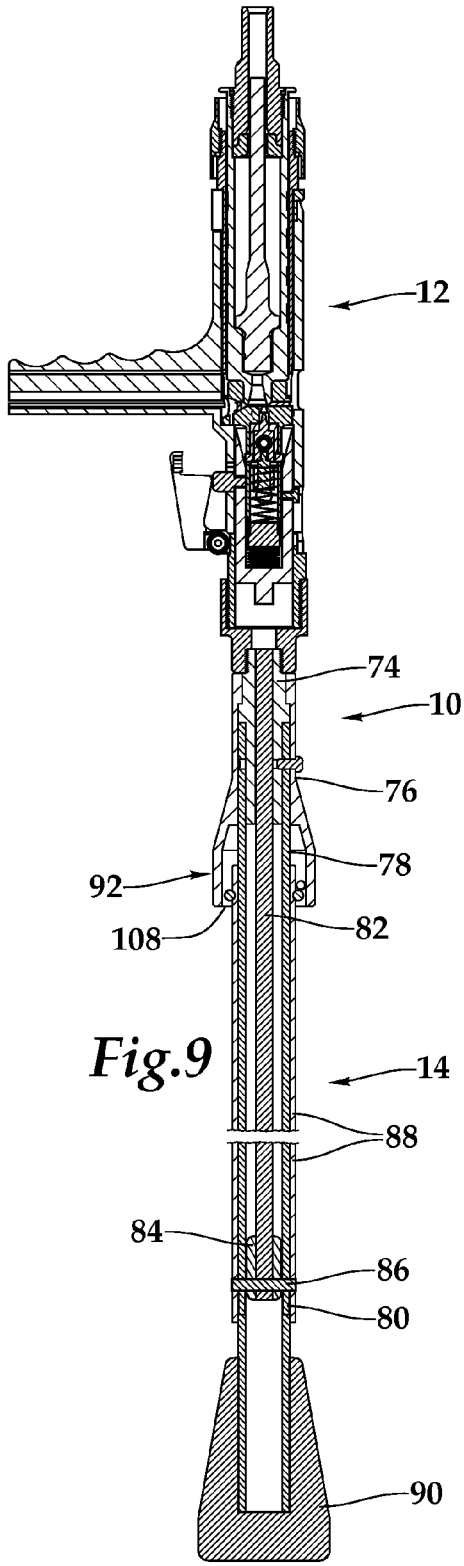
FIG. 9 is a sectional view of the tool system of FIG. 7 just prior to being fired.

Referring to FIGS. 8-9, a novel fastener driving or actuation system 10 is shown. System 10 may comprise a tool 12 operatively coupled to a pole assembly 14 having a lockout mechanism 92, with components of each portion described in detail below. In particular, the tool 12 may have a trigger sleeve 60 having a frustoconical forward end 62, the trigger sleeve 60 slidable within a housing 20 such that a forward movement of the trigger sleeve 60 by a predetermined distance releases a spring-loaded firing pin sear 54, thereby releasing the firing pin assembly 40 towards a load 17 for actuation of the tool. In addition, tool 12 may include an advance pin 29 for operatively engaging a ramp surface 23 of an advance lever 22 to automatically load the next load 17. Moreover, pole assembly 14 may be coupled to tool 12, e.g., releasably coupled, and may include an internal rod 82 coupled to an outer sleeve 88 for actuation of the system 10. Actuation may result from internal rod 82 bearing against and driving forward a rod-contacting portion 70 of sleeve 60, although actuation only may occur when system 10 is not pointed below a horizontal and therefore inhibited due to the action of lockout mechanism 92.

As can be seen in FIGS. 1-4, tool 12 may comprise a housing 20 surrounding a barrel assembly 30. Barrel assembly 30 may have a muzzle end 32 protruding forward from housing 20 and a breech end 34 spaced rearward from muzzle end 32 and contained within housing 20. Barrel assembly 30 may also comprise a piston 36 disposed between muzzle end 32 and breech end 34 and slidable within barrel assembly 30.

In addition, barrel assembly 30 may comprise a cocking rod 38 extending generally rearward from breech end 34. Cocking rod 38 may be generally cylindrical, and may have a length between about 1 inch and about 3 inches, preferably between about 1½ inches and about 2½ inches, still more preferably between about 1¾ inches and about 2¾ inches. Cocking rod 38 may also be offset from a centerline of barrel assembly 30. In this way, cartridge or load 17 may be generally aligned with centerline so that combustive and/or explosive forces acting on piston 36 cause piston 36 to be driven axially along length of barrel assembly 30.

Figure 1:
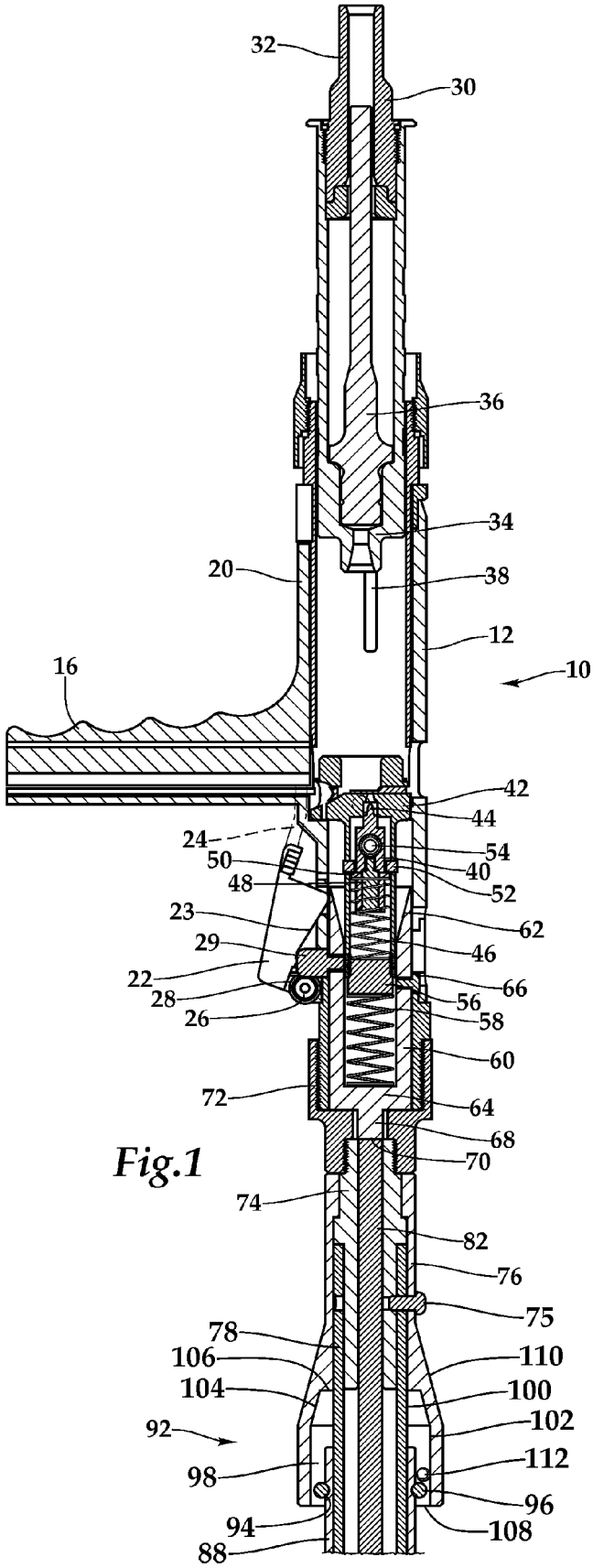
FIG. 1 is a sectional view of an exemplary tool in an initial or final position.

Tool 12 also may comprise breech block 42 having a forward end. Breech block 42 may have a plurality of openings forming a channel generally perpendicular to a length of breech block 42 for receiving unused cartridges 17 and evacuating spent cartridges 17. As seen in FIG. 1, channel in breech block 42 may be generally aligned with grip 16, which is useful when unused cartridges 17 are stored within and fed through grip 16. Forward end of breech block 42 may be shaped similarly to breech end 34 of barrel assembly 30 so that barrel assembly 30 may substantially interface with breech block 42 when muzzle end 32 of tool 12 is depressed against work surface 2. Rearward end of breech block 42 may interface with spring plug 56, for example via an interference fit or through threaded engagement with spring plug 56.

Staying with FIGS. 1-4, tool 12 may have firing pin assembly 40 proximate rearward end of breech block 42, slidable with respect to breech block 42. Firing pin assembly 40 may include firing pin tip 44, compression spring 46, rebounder 48 and rebound washer 50, and rebound washer 50 may be disposed around rebounder 48. Firing pin assembly 40 may slide within breech block 42, but movement may be limited in both sliding directions. Rearward movement may be constrained by compression of spring 46 between spring plug 56 and rebounder 48 or rebound washer 50. Similarly, breech block 42 may have one or more bosses 52 circumferentially disposed within breech block 42. Forward movement of firing pin assembly 40 may then be limited by contact between rebound washer 50 and bosses 52.

Figure 10:
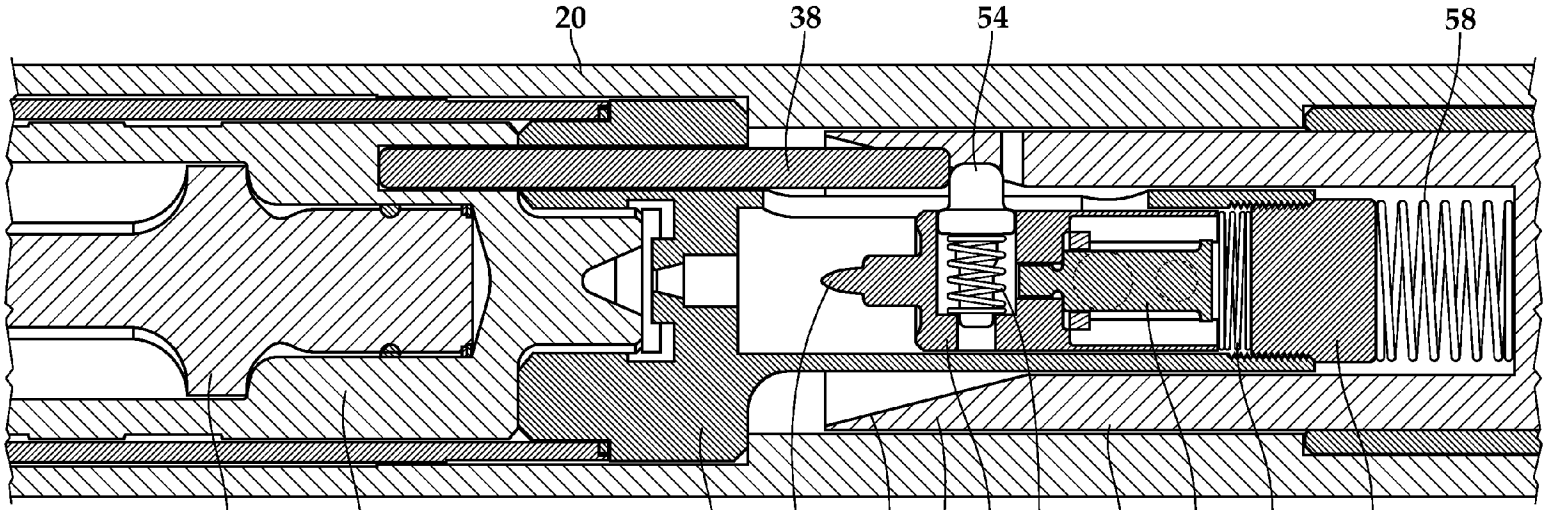
FIG. 10 is a section view of the tool of FIGS. 1-3, rotated 90 degrees from the view of FIGS. 1-3, showing the cocking rod contacting the firing pin sear to load the firing pin assembly.
Figure 11:
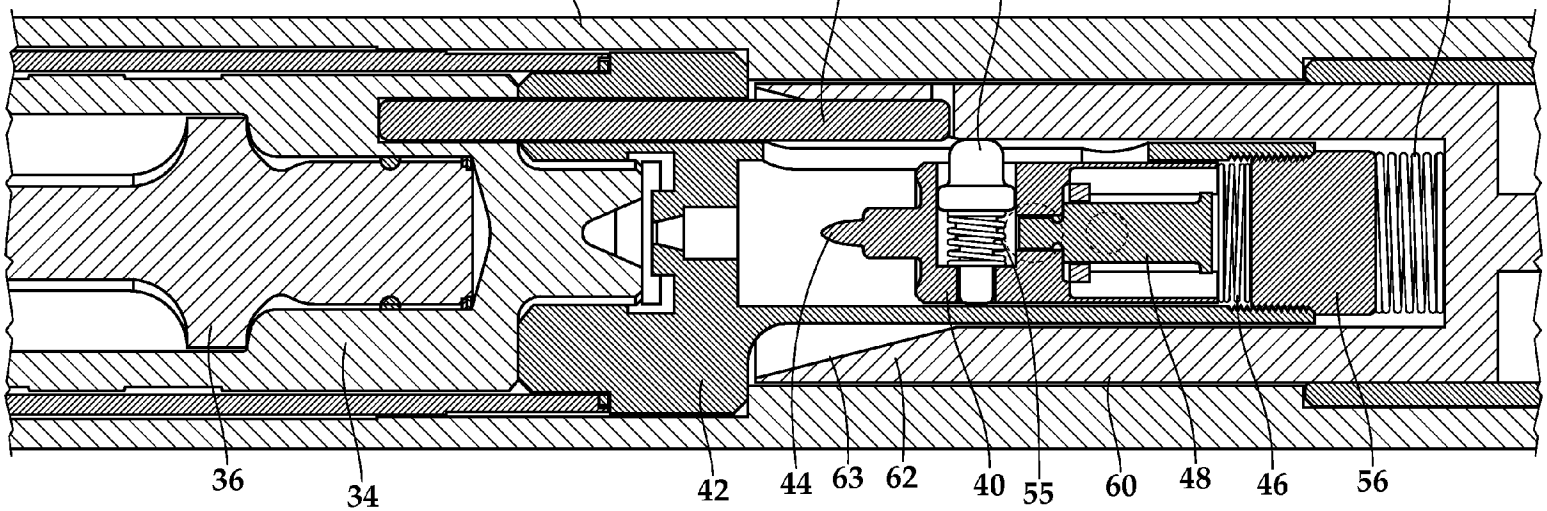
FIG. 11 is a section view of the tool of FIGS. 1-3, rotated 90 degrees from the view of FIGS. 1-3, showing the trigger sleeve releasing the firing pin sear to fire the firing pin assembly.

Firing pin assembly 40 may further comprise a firing pin sear 54. Sear 54 may be disposed generally perpendicular to length of housing 20, but sear 54 may have other orientations. As can be seen in FIG. 10, sear 54 may be biased to an initial state protruding from firing pin assembly 40 through use of spring 55. Rearward motion of cocking rod 38 may depress firing pin sear 54, compressing spring 55, and holding sear 54 within firing pin assembly 40 in order to load firing pin assembly 40.

Figure 5:
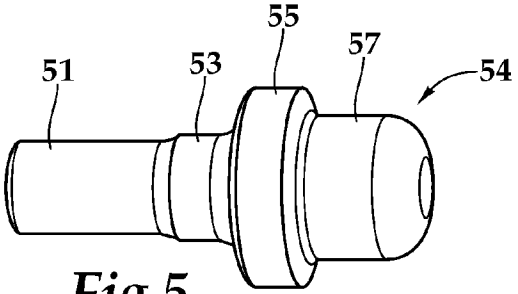
FIG. 5 is a perspective view of a firing pin sear.

Turning to FIG. 5, sear 54 may comprise a series of generally cylindrical portions 51, 53, 55, 57 having varying diameters and may further include radii of curvature or chamfers between varied diameter portions 51, 53, 55, 57. Portion 51 may have a diameter between about 1 mm and about 6 mm, preferably between about 3 mm and about 5 mm, still more preferably about 3.5 mm, and a length of between about 2 mm and about 8 mm, preferably between about 4 mm and about 7 mm, and in one embodiment about 6.35 mm. Portion 53 may have a diameter between about 1.5 mm and about 6.5 mm, preferably between about 3.5 mm and about 5.5 mm, still more preferably about 4 mm. Portion 55 may have a diameter between about 5 mm and about 10 mm, preferably between about 6 mm and about 8 mm, still more preferably between about 7 mm and about 8 mm, and in one embodiment about 7.5 mm, and a length between about 1 mm and about 4 mm, preferably between about 2 mm and about 3 mm, and in one embodiment, about 2.4 mm. Portion 57 have a diameter between about 3 mm and about 8 mm, preferably between about 4 mm and about 6 mm, and in one embodiment, about 5⅓ mm, and a length between about 2 mm and about 6 mm, preferably between about 3.5 mm and about 5 mm, and in one embodiment, about 4⅓ mm. Overall, sear 54 may have a length between about 10 mm and about 20 mm, preferably between about 13 mm and about 17 mm, and in one embodiment, about 15¾ mm.

Figure 6:
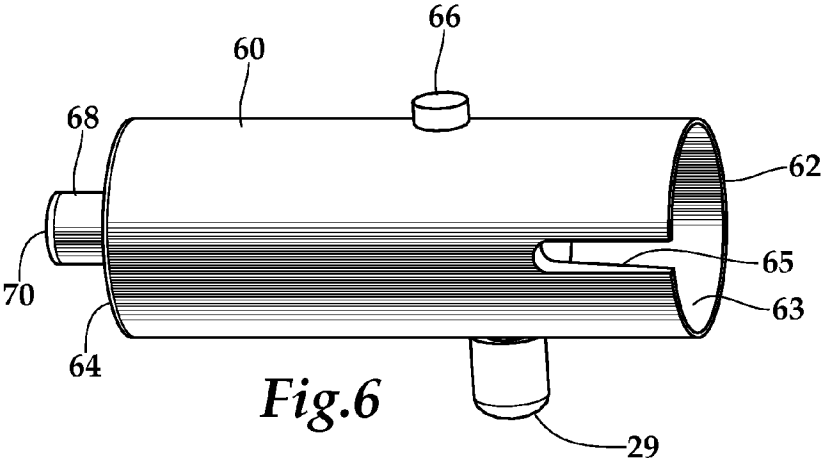
FIG. 6 is a perspective view of a trigger sleeve assembly.

Housing 20 further may hold a trigger sleeve 60 slidable within housing 20 between a first and a second position. Tool 12 may comprise a second compression spring 58 between spring plug 56 and rearward end 64 of trigger sleeve 60 so as to bias sleeve 60 to a rest position. As seen in FIG. 6, trigger sleeve 60 may be a hollow generally cylindrical body having an open forward end 62 and a closed rearward end 64. Forward end 62 may have a tapered wall so as to form a frustoconical forward surface 63, narrowing in a direction into trigger sleeve 60 and away from muzzle end 32 of tool 12. Outer portion of forward end 62 may have a diameter sized slightly smaller than inner diameter of housing 20 so as to allow trigger sleeve 60 to move freely within housing 20. Inner portion of forward end 62 may have a diameter sized slightly larger than rear portion of breech block 42 so as to allow trigger sleeve 60 to also slide freely between housing 20 and breech block 42. In addition, forward end 62 may have a radial notch or channel 65 from the outer portion to the inner portion, extending substantially the length of tapered portion 63. Channel 65 may provide clearance for cocking rod 38 to pass through as cocking rod 38 moves rearward to load firing pin assembly and/or as trigger sleeve 60 moves forward to fire tool 12.

Staying with FIG. 6, trigger sleeve 60 may have a limiter 66 such as a pin or bolt coupled to sleeve 60. Limiter 66 may extend outward from trigger sleeve 60 and at least partially through housing 20. As such, limiter 66 may move along a slot within housing 20, establishing a maximum forward position for trigger sleeve 60.

Rearward end 64 of trigger sleeve 60 may be a generally solid cylindrical body with a smaller generally cylindrical portion extending rearward to form protrusion 68. Protrusion 68 may be sized to be slightly smaller than an opening in the rear end of tool 12, the opening forming a coupler 72.

Trigger sleeve 60 may have a second opening for holding advance pin 29. Second opening may be generally diametrically opposed from limiter 66, and advance pin 29 may extend through a channel or other opening in housing 20 toward advance lever 22.

Figure 7:
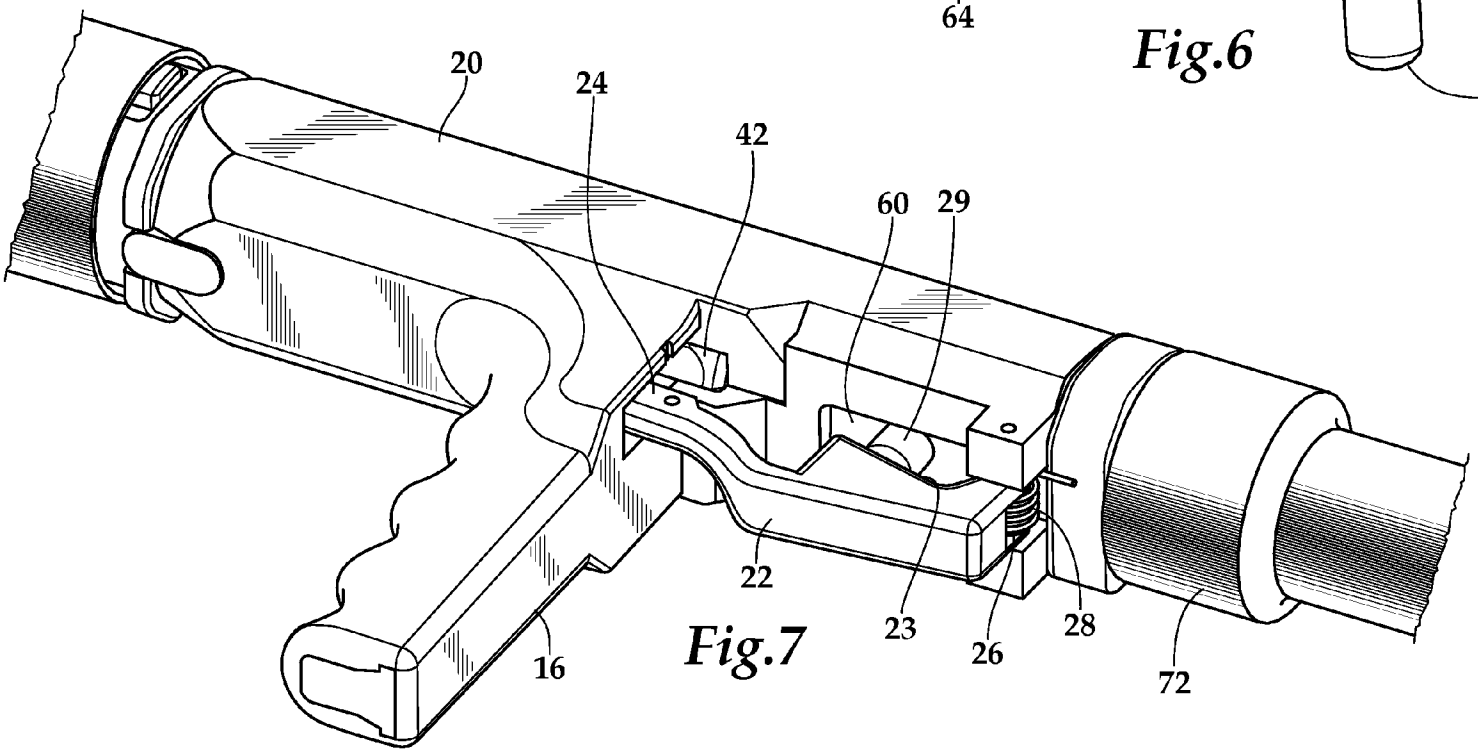
FIG. 7 is a perspective view of a portion of the underside of the tool of FIGS. 1-4.

Turning to FIG. 7, and as also seen in FIGS. 1-4, advance pin 29 may move along ramp surface 23 of advance lever 22 to cam lever between several positions during operation. Advance lever 22 may be coupled to housing at one end, preferably a rearward end. Mandrel 26 and torsion spring 28 may be spaced between arms of advance lever 22, with torsion spring 28 biasing advance lever 22 to an initial position. In addition, advance lever 22 may have advance lever finger 24 at a forward end. Finger 24 may extend to a forward end of lever 22 into grip 16 for advancing cartridges or loads 17 after tool is fired.

Coupler 72 may interface with a second coupler 74, the second coupler disposed on pole assembly 14. Turning to FIGS. 8-9, coupler 72 may threadingly engage second coupler 74, but other forms of connection are possible, including, e.g., an interference fit.

Staying with FIGS. 8-9, pole assembly 14 may include a pole 78 extending substantially the length of pole assembly 14 to a handle 90. Pole assembly 14 may come in various lengths, e.g., about 3 ft., about 6 ft. or about 8 ft. lengths, so that tool system 10 may be adaptable to a variety of uses. In addition, pole assembly 14 may include one or more extenders for coupling to a forward end of pole assembly 14 in order to further lengthen pole assembly 14. Moreover, pole 78 may have an outer diameter of between about ½ inch and about 2 inches, preferably between about ¾ inch and about 1½ inches, still more preferably about 1 inch. Pole 78 may also have an inner diameter of between about ¼ inch and about 1½ inches, preferably between about ½ inch and about 1 inch, still more preferably about ¾ inches.

Second coupler 74 may extend a predetermined distance inside pole 78, for example, via an interference fit, which may serve to reinforce pole 78. Second coupler 74 may extend between about 1 inch and about 6 inches into pole 78, preferably between about 1 inch and about 4 inches. In one embodiment, second coupler 74 may also fit over the end of pole 78 and extend a second predetermined distance along outside of pole 78. Alternatively, or in addition, assembly 14 may also include a reinforcing sleeve 76 proximate second coupler 74 and extending around an outer surface of pole 78. Reinforcing sleeve may be coupled to pole 78 and/or to second coupler 74, for example, through the use of one or more fasteners 75.

Still staying with FIGS. 8-9, pole assembly additionally includes an internal rod 82 within pole 78 and extending substantially along the length of pole 78. Internal rod 82 may be coupled to cap 84, preferably proximate handle 90. As with pole 78, internal rod 82 may come in various lengths, each of which is preferably shorter than its corresponding pole 78 length. For example, a 3 foot pole 78 may have an internal rod 82 about 31 inches long, a 6 foot pole 78 may have an internal rod 82 about 67 inches long, and an 8 foot pole 78 may have an internal rod 82 about 91 inches long. Internal rod 82 may also be sized smaller than inner diameter of pole 78. Preferably, internal rod 82 may have a diameter about half that of inner diameter of pole 78.

Cap 84 may be coupled in various ways to internal rod, such as by press fitting cap 84 over internal rod 82. As shown in FIGS. 8-9, pin 86 may pass through cap 84 and internal rod 82, as well as sleeve 88. Pole 78 may have one or more slots 80 along which pin may travel, so as to allow sleeve 88 to move along a length of pole 78, thereby actuating tool system 10. Slots 80 may have a length between about ½ inch and about 6 inches, preferably between about ½ inch and about 2 inches, still more preferably between about ½ inch and about 1 inch, and in one embodiment, about ¾ inch. In addition, as seen in FIGS. 8-9, sleeve 88 may extend substantially along the length of pole 78 in order to provide a user with a variety of hand placement options. Sleeve 88 may be between about 10% and about 85% a length of pole 78, preferably between about 40% and about 85%, still more preferably between about 65% and about 85%. However, sleeve 88 may also be relatively short, for example between about 4 inches and about 6 inches, which may provide adequate surface area for a user's hand while requiring less material to make sleeve 88. In this case, sleeve 88 may be coupled to a secondary sleeve proximate second coupler 74 with second sleeve providing lockout functionality, as described below.

Returning to FIGS. 1-4 and 8-9, prior to compression against work surface 2, tool system 10 may initially be in a configuration such as the one shown in FIGS. 1 and/or 7. In this configuration, barrel assembly 30 extends forward from housing 20, firing pin assembly 40 is in a forward position—but not its most forward position, which occurs during firing—sear 54 is not engaged and trigger sleeve 60 is biased to its rearward position. In addition, advance pin 29 protruding from trigger sleeve 60 may rest against a rearward portion of ramp surface 23 on advance lever 22, with torsion spring 28 biasing advance lever 22 to this rest position.

Figure 2:
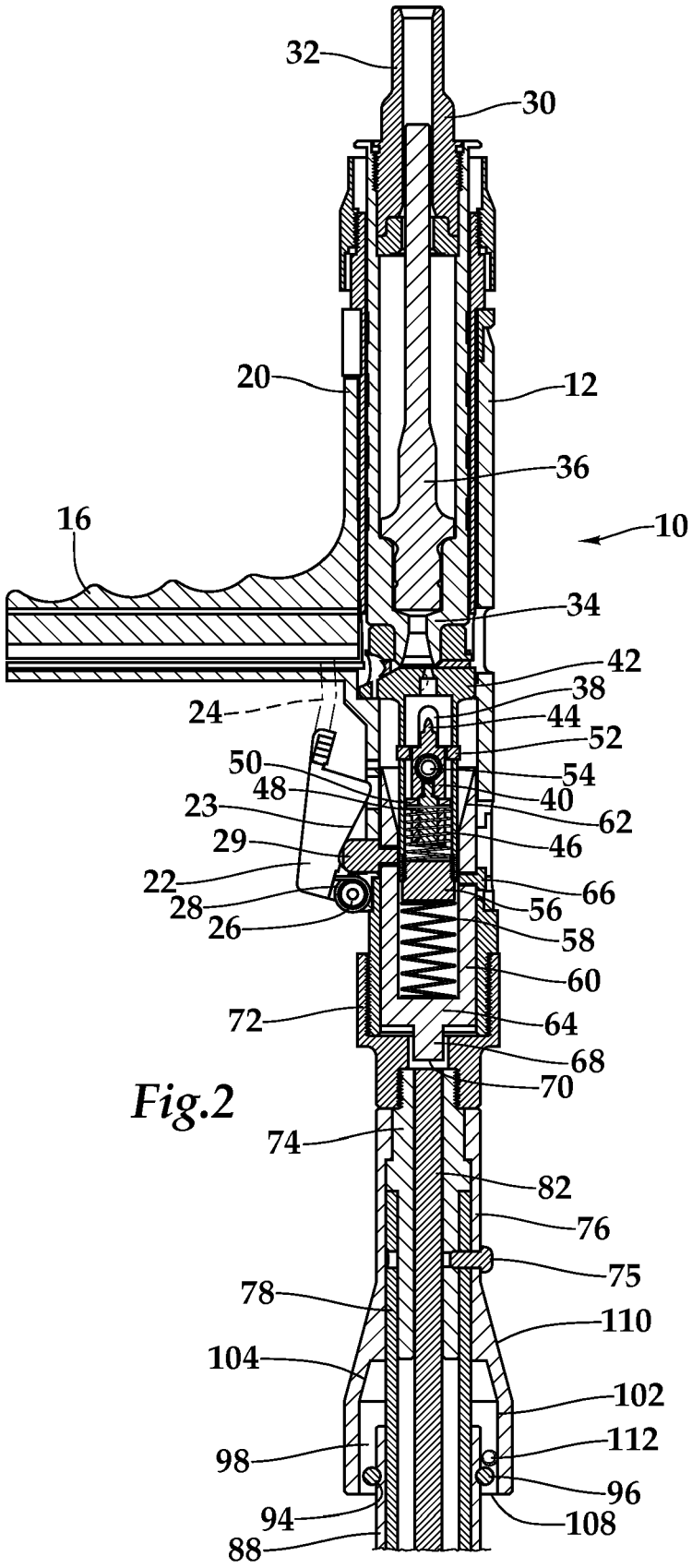
FIG. 2 is a sectional view of the tool of FIG. 1 in a ready-to-fire position.

As seen in FIG. 2, upon depressing muzzle end 32 against a work surface 2, barrel assembly 30, including cocking rod 38, slides into housing 20. Cocking rod 38 may slide rearward through an opening in breech block 42, engaging firing pin assembly 40, biasing firing pin assembly 40 to a rearward position and engaging firing pin sear 54.

Turning again to FIG. 3 and FIG. 9, when a user wishes to trigger tool system 10, the user slides sleeve 88 along pole 78, which moves internal rod 82 to a forward position. Rod 82 interfaces with rod contacting portion 70 of trigger sleeve 60, moving trigger sleeve 60 to a forward position. As trigger sleeve 60 moves forward, a portion of firing pin sear 54 may travel along tapered forward end 62 of trigger sleeve 60, which may cause sear 54 to cam towards a release point. When the release point is reached, sear 54 may release, causing spring 58 to extend, propelling firing pin assembly 40 forward into load 17, detonating load 17. Detonation may drive piston 36 forward, driving fastener 4 out of muzzle end 32 and into work surface 2. In addition, forward motion of trigger sleeve 60 may cause advance pin 29 to translate along ramp surface 23, camming advance lever 22 with advance lever finger 24 downward into grip where lever finger 24 may engage a portion of strip holding cartridges 17.

After tool system 10 has been actuated, a user may release sleeve 88, translating internal rod 82 to its rearward position. With force applied by internal rod 82 removed, spring 58 may extend to bias trigger sleeve 60 to its rearward, rest position. As trigger sleeve 60 moves, advance pin 29 coupled to trigger sleeve 60 may also slide rearward along ramp surface 23. Motion along ramp surface 23 may cam advance lever 22 and finger 24 toward a rest position, and camming of finger 24 may advance strip holding cartridges 17, loading a new cartridge 17 into breech block 42. This advancement mechanism may eliminate the need for a user to perform a separate action to advance cartridges 17, for example through use of a manual advance.

Returning to FIGS. 1-4, tool system 10 also may include a lockout mechanism 92 to prevent misfires, e.g., when tool is angled below a horizontal level. Lockout mechanism 92 may comprise an annular channel 98 within a rear end 108 of sleeve 76. Channel 98 may have an inner wall 100, which may be coincident with an outer wall of pole 78. In addition, channel 98 may have an outer wall 102, which may be coincident with an inner wall of sleeve 76. Outer wall 102 may taper inward frustoconically toward a forward end 106 of channel 98. Outer wall 110 of sleeve 76 also may taper inwards in a direction from rear end toward forward end, and in the embodiment of FIGS. 1-4, taper of outer wall 110 of sleeve 76 may be substantially similar to taper of outer wall 102 of channel 98. Internal taper 104 may be between about 5 degrees and about 20 degrees with respect to an axial centerline of pole assembly 14, preferably between about 10 degrees and about 20 degrees, and in one embodiment, about 14 degrees.

Lockout mechanism 92 may include one or more balls 112 for movement within channel 98. In addition, lockout mechanism 92 may include a seal 96 or other stop to retain balls 112 within channel 98. As seen in FIG. 1, seal 96 may comprise an O-ring seated within a groove 94 on the outer surface of sleeve 88. Although one ball 112 is shown in the figures, a plurality of balls may be used, e.g., about 3 balls, which may provide redundancy to the system 10.

Figure 3:
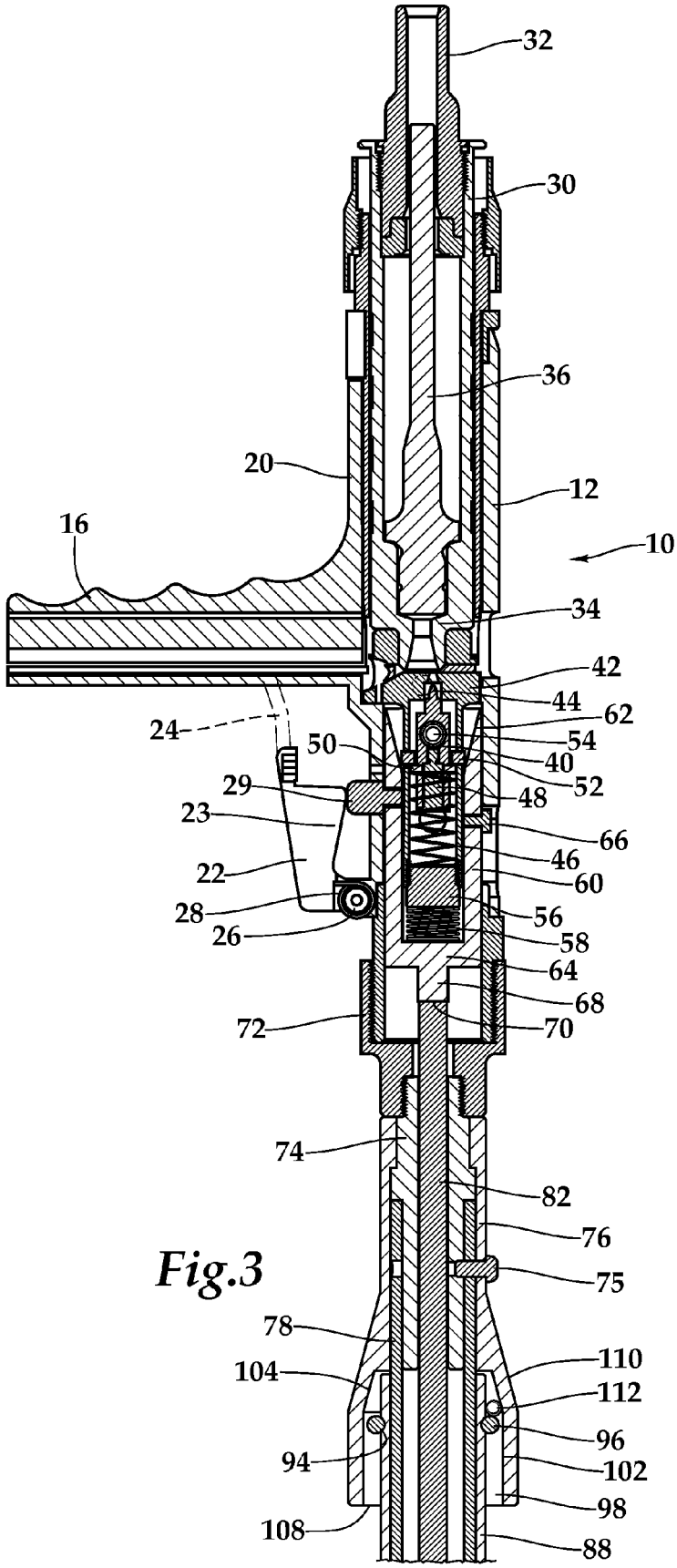
FIG. 3 is a sectional view of the tool of FIG. 1 just prior to being fired.

FIGS. 1-3 show tool system 10 in a non-locked out position. This position may be anywhere from upright, i.e., directly opposite the force of gravity, to about 90 degrees, i.e., about horizontal or perpendicular to the force of gravity. In this position, sleeve 88 may be able to move laterally from a start position to a firing position where forward end 89 of sleeve 88 is proximate forward end 106 of channel 98. In addition, while sleeve 88 is actuated forward, ball 112 may roll between outer surface of sleeve 88 and outer wall 102 of channel 98. Internal taper 104 of channel 98 may be such that ball is biased toward rear 108 of channel 98, which is wider than forward end 106, such that there is sufficient room between pole 78 and outer wall 102 for both sleeve 88 and ball 112. When in a generally vertical position, system 10 may bias ball 112 so that ball 112 rests against seal 96, leaving clearance above sleeve 88 for full motion of sleeve 88 to a firing position proximate forward end 106 of channel 98. When system 10 is angled between a horizontal and a vertical position, ball 112 may slide along internal taper 104, down and away from forward end 106, leaving clearance for sleeve 88 to attain a firing position.

Figure 4:
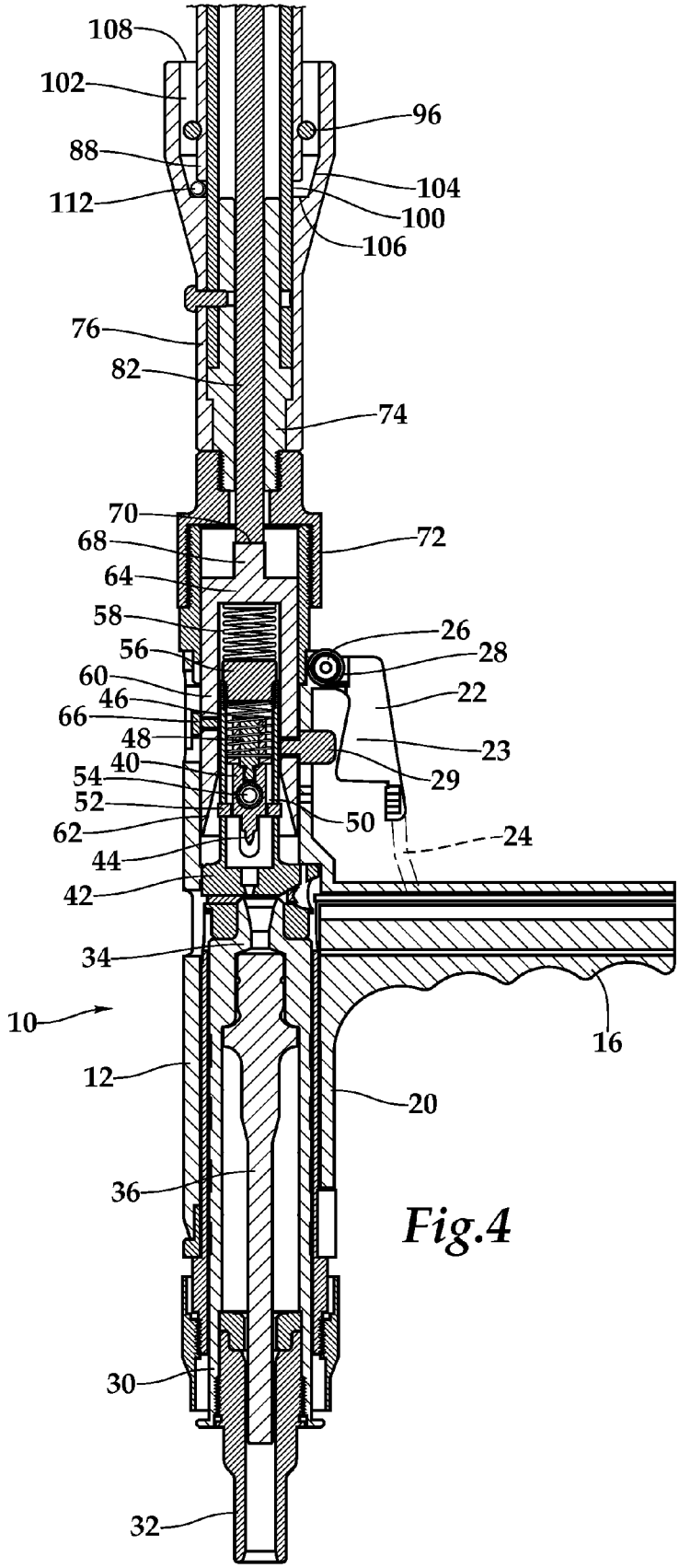
FIG. 4 is a sectional view of the tool of FIG. 1 in a downward orientation with firing inhibited by a lockout mechanism.

Turning to FIG. 4, tool system 10 is shown in a, locked-out position that occurs when system 10 is oriented in any angle greater than horizontal, i.e., perpendicular to the force of gravity. In this position, internal taper 104 may bias ball 112 toward forward end 106 of channel 98. Forward end 106 of channel 98 may have a width between outer surface of pole 76 and forward end of taper 104 that is less than the combined width of the forward end of sleeve 88 and of ball 112. As such, in a locked-out position, because ball 112 is biased toward forward end 106 of channel 98, lockout mechanism 92 prevents accidental firing of tool system 10 because ball 112 prevents forward end of sleeve 88 from reaching a firing position proximate forward end 106 of channel 98. Because sleeve 88 cannot extend forward fully, internal rod 82 cannot either, which means that forward end 62 of trigger sleeve 60 does not slide far enough to release firing pin sear 54, so firing pin 40 is not released.

While the foregoing written description of the invention enables one of ordinary skill to make and use what is considered presently to be the best mode thereof, those of ordinary skill will understand and appreciate the existence of variations, combinations, and equivalents of the specific exemplary embodiments and methods herein. The invention should therefore not be limited by the above described embodiments and methods, but by all embodiments and methods within the scope and spirit of the invention as claimed.

What is claimed is:

1. A fastener actuation system, comprising:

a fastener actuation tool coupled to a pole assembly, said fastener actuation tool comprising:

a housing having a barrel assembly slidable therein, said barrel assembly having a muzzle end and a breech end, said barrel assembly further comprising a cocking rod extending generally rearward from said breech end;

a piston slidable within said barrel assembly;

a breech block coupled to said housing;

a firing pin assembly slidable within said breech block; and a trigger sleeve;

said pole assembly comprising:

a pole extending substantially along a length of said pole assembly;

a handle coupled to said pole;

an internal rod within said pole and slidable with respect to said pole;

a sleeve external to said pole and coupled to said internal rod; and a lockout mechanism proximate a forward end of said pole assembly;

wherein said trigger sleeve is slidable with respect to said housing and said firing pin assembly, said trigger sleeve coupled to a limiter and an advance pin, said trigger sleeve having a rod-contacting portion for operatively engaging said internal rod of said pole assembly, said fastener actuation tool further comprising an advance lever adapted to be engaged by said advance pin and having a finger for advancing a load-carrying strip.

2. A fastener actuation system according to claim 1, said fastener actuation tool further comprising:

a firing pin sear within said firing pin assembly.

3. A fastener actuation system according to claim 2, wherein said trigger sleeve has a tapered forward surface for slidable engagement with said firing pin sear.

4. A fastener actuation system according to claim 1, wherein depressing said barrel assembly loads said firing pin assembly.

5. A fastener actuation system according to claim 1, said pole assembly further comprising:

a slot in said pole, wherein said internal rod is coupled to said sleeve via a coupler passing through said slot.

6. A fastener actuation system according to claim 1, wherein said fastener actuation tool is threadably engaged with said pole assembly.

7. A fastener actuation system according to claim 1, said pole assembly further comprising a coupler and a reinforcing sleeve at an end of said assembly; and said lockout mechanism further comprising:

a channel extending inward from a rear end of said reinforcing sleeve, said channel having an outer wall that tapers inward proximate a forward end of said channel;

and at least one ball movable within said channel.

8. A fastener actuation system according to claim 7, wherein sleeve has a thickness and said at least one ball has a diameter, further wherein a rear end of said channel has a width greater than a combination of said thickness and said diameter, and further wherein said forward end of said channel has a width less than the combination of said thickness and said diameter.

9. A fastener actuation tool comprising:

a housing;

a barrel assembly at least partially contained within said housing and slidable with respect to said housing;

a piston within said barrel assembly and slidable with respect to said barrel assembly and said housing;

a breech block generally fixed with respect to said housing;

a firing pin assembly at least partially contained within said breech block and slidable with respect to said breech block, said firing pin assembly comprising a firing pin tip, a spring, a rebounder and a firing pin sear, wherein said firing pin sear is slidable along a channel in said breech block; and a trigger sleeve slidable with respect to said housing and said firing pin assembly;

wherein depressing said barrel assembly loads said firing pin assembly in a ready-to-fire position;

and further wherein sliding said trigger sleeve toward said barrel assembly releases said firing pin sear, accelerating said firing pin assembly toward a load in said breech block.

10. A fastener actuation tool according to claim 9, wherein said barrel assembly further comprises a cocking rod, wherein depressing said barrel assembly causes said cocking rod to contact said firing pin assembly and move said firing pin assembly into said ready-to-fire position.

11. A fastener actuation tool according to claim 9, wherein said trigger sleeve has a tapered forward surface for contacting and releasing said firing pin sear.

12. A fastener actuation tool according to claim 9, wherein said firing pin tip is biased to a generally forward starting position by a compression spring and said trigger sleeve is biased to a generally rearward starting position by a second compression spring.

13. A fastener actuation tool according to claim 9, wherein said breech block has a channel for receiving unused cartridges and a second channel for expelling spent cartridges.

14. A fastener actuation tool according to claim 9, further comprising:

an advance lever coupled to said housing, said advance lever biased to a rest position using a torsion spring, said advance lever having a surface for interfacing with an advance pin coupled to said trigger sleeve, wherein forward movement of said trigger sleeve depresses a finger of said advance lever and rearward movement of said trigger sleeve raises said finger, thereby advancing an unused cartridge into said breech block.

15. A fastener actuation pole assembly, comprising a pole having a tool end and a handle end, said pole extending substantially a length of said pole assembly and coupled to a handle at said handle end;

a coupler at a tool end of said pole for engaging a tool, said coupler extending a predetermined length within said pole;

an internal rod within said pole and slidable with respect to said pole;

a sleeve around at least a portion of said pole, said sleeve coupled to, and slidable with, said internal rod; and a lockout mechanism at said tool end, said lockout mechanism comprising a channel having at least one ball disposed therein, said channel having a generally axially oriented inner wall and an outer wall that tapers inward proximate a forward end of said channel, wherein said forward end has a width between said inner wall and said outer wall less than a combined width of said sleeve and one of said at least one balls.

16. A fastener actuation pole assembly according to claim 15, further comprising:

a reinforcing sleeve coupled to and disposed around said pole at said tool end.

17. A fastener actuation pole assembly according to claim 15, further comprising:

a cap at a handle end of said internal rod and a slot in said pole proximate said handle end of said pole;

wherein said cap couples to said internal rod, and further wherein a coupler connects said cap to said sleeve, said coupler passing through said slot.

18. A fastener actuation pole assembly according to claim 15, wherein said pole has an outer diameter of about 1 inch and said internal rod has a diameter of about ⅜ inch.

19. A fastener actuation pole assembly according to claim 15, wherein said pole has a length of about 6 feet.

20. A fastener actuation pole assembly according to claim 15, wherein said pole has a length of about 8 feet.

* * * * *